US012590412B2

(12) United States Patent
Imig

(10) Patent No.: US 12,590,412 B2
(45) Date of Patent: Mar. 31, 2026

(54) RECOVERY BOILER STARTUP BURNER ASSEMBLY

(71) Applicant: ANDRITZ INC., Alpharetta, GA (US)

(72) Inventor: Gregory Alan Imig, Suwanee, GA (US)

(73) Assignee: ANDRITZ INC., Alpharetta, GA (US)

( * ) Notice: Subject to any disclaimer, the term of this patent is extended or adjusted under 35 U.S.C. 154(b) by 57 days.

(21) Appl. No.: 18/816,213

(22) Filed: Aug. 27, 2024

(65) Prior Publication Data

US 2024/0417927 A1 Dec. 19, 2024

Related U.S. Application Data

(63) Continuation of application No. 17/229,982, filed on Apr. 14, 2021, now abandoned.

(60) Provisional application No. 63/009,689, filed on Apr. 14, 2020.

(51) Int. Cl.
*D21C 11/10* (2006.01)
*F23D 14/24* (2006.01)

(52) U.S. Cl.
CPC ..... *D21C 11/10* (2013.01); *F23D 14/24* (2013.01); *F23D 2900/11402* (2013.01); *F23D 2900/3102* (2021.05)

(58) Field of Classification Search
None
See application file for complete search history.

(56) References Cited

U.S. PATENT DOCUMENTS

| | | | |
|---|---|---|---|
| 3,109,481 | A | 11/1963 | Yahnke |
| 4,924,784 | A | 5/1990 | Lennon et al. |
| 5,131,334 | A | 7/1992 | Monro |
| 5,564,632 | A | 10/1996 | Prohazka |
| 6,174,161 | B1 | 1/2001 | Slavejkov et al. |
| 9,638,421 | B2 | 5/2017 | Imig |
| 2005/0263108 | A1 | 12/2005 | Engvall |
| 2015/0233579 | A1 | 8/2015 | Imig |
| 2019/0293285 | A1 | 9/2019 | Nett et al. |

FOREIGN PATENT DOCUMENTS

| | | |
|---|---|---|
| CL | 199702536 | 8/1998 |
| JP | 63286602 | 11/1988 |
| KR | 20120038042 | 4/2012 |
| KR | 101283569 B1 | 7/2013 |

OTHER PUBLICATIONS

Brazilian Patent Application No. BR112022020751-4, Office Action, Aug. 20, 2024, 7 pages (2 pages English translation and 5 pages original document.

(Continued)

*Primary Examiner* — Jelitza M Perez
(74) *Attorney, Agent, or Firm* — Kilpatrick Townsend & Stockton LLP

(57) ABSTRACT

A startup burner assembly for a recovery boiler, the startup burner assembly includes a housing having a burner end and a second end distal to the burner end; a main fuel conduit disposed within the housing; and at least one high-pressure air conduit disposed within the burner end of the housing. The high-pressure air conduit includes at least one angled air injection nozzle configured to direct high-pressure air exiting the burner end of the startup burner assembly in a rotational direction.

22 Claims, 6 Drawing Sheets

(56) References Cited

OTHER PUBLICATIONS

Brazilian Patent Application No. BR112022020751-4, Office Action, Aug. 12, 2024, 7 pages (2 pages English translation and 5 pages original document).
Chile Application No. 02747-2022, Notice of Allowance, Jul. 29, 2024, 2 pages (1 page English summary and 1 page original document).
Chile Application No. 02747-2022, Office Action, May 17, 2024, 17 pages (2 pages English summary and 15 pages original document).
Chile Application No. 02747-2022, Office Action, Feb. 27, 2024, 18 pages (3 pages English summary, 15 pages original document).
Canadian Application No. 3173217, Office Action, Jan. 11, 2024, 4 pages.
International Application No. PCT/US2021/027186, International Preliminary Report on Patentability, Oct. 27, 2022, 8 pages.
International Application No. PCT/US2021/027186, International Search Report and Written Opinion, Jul. 14, 2021, 12 pages.
English Translation of KR 101283569 B1, Jul. 5, 2013, 27 pages.
U.S. Appl. No. 17/229,982, Corrected Notice of Allowability mailed on Aug. 15, 2024, 2 pages.
U.S. Appl. No. 17/229,982, Corrected Notice of Allowability mailed on Sep. 5, 2024, 2 pages.
U.S. Appl. No. 17/229,982, Non-Final Office Action mailed on Apr. 9, 2024, 16 pages.
U.S. Appl. No. 17/229,982, Notice of Allowance mailed on Aug. 1, 2024, 17 pages.

RECOVERY BOILER STARTUP BURNER ASSEMBLY

CROSS-REFERENCES TO RELATED APPLICATIONS

This application is a continuation of U.S. patent application Ser. No. 17/229,982, filed Apr. 14, 2021, which application claims the benefit of U.S. Provisional Application No. 63/009,689, filed Apr. 14, 2020, the contents of which applications are hereby incorporated herein by reference in their entireties.

BACKGROUND

Unless otherwise indicated herein, the materials described in this section are not prior art to the claims in this application and are not admitted to be prior art by inclusion in this section.

Chemical recovery boilers isolate useful compounds from manufacturing byproducts. In the pulp and paper industry, pulp mills typically use a manufacturing process in which wood chips or another lignocellulosic biomass are treated with a chemical liquor comprising cooking chemicals. The wood chips or other lignocellulosic materials are then cooked in a digester at a predetermined temperature and pressure to form a slurry that consists of spent chemical liquor and a rough pulp with inconsistent particle size. After cooking, the spent chemical liquor may be washed from the rough pulp. The spent chemical liquor is commonly known as "black liquor" and includes organic and inorganic chemicals left over from the cooking process. The pulp is generally sent to other equipment for further refinement. The black liquor is eventually pumped to a chemical recovery boiler and processed to recover the cooking chemicals.

Recovering and reusing the cooking chemicals from the black liquor make industrial paper-making processes cost-effective. Chemical recovery boilers evaporate excess moisture from black liquor solids, burn organic liquor components, supply heat for steam generation, and recover inorganic compounds, for example, sodium sulfide and sodium carbonate. Some of these compounds can be recausticized and used elsewhere in the manufacturing process.

FIG. 1 is a simplified diagram of a conventional recovery boiler 100. The recovery boiler 100 may include a furnace 110, water walls 120, spray nozzles 130, and air injection nozzles 140*a*-140*c*.

During the recovery process, the black liquor is concentrated into a solution containing a solids concentration greater than sixty percent by mass. Spray nozzles 130 extending through a water wall 120 of the recovery boiler furnace 110 spray black liquor into the furnace 110. The spray nozzles 130 are generally located in the bottom quarter of the furnace 110 and may be several meters above the bottom of the furnace. The furnace 110 is a reactor that dries and partially pyrolyzes the black liquor droplets 132 as they fall toward the bottom of the furnace 110. The furnace 110 evaporates, gasifies, oxidizes, and reduces, components within the black liquor to recover the cooking chemicals.

Air injection nozzles 140*a*-140*c* typically permit airflow into the furnace at low, middle, and upper elevations. A primary air injection nozzle 140*a* may be located at a low elevation of the furnace 110, a secondary air injection nozzle 140*b* may be located at a middle elevation of the furnace 110, and a tertiary air injection nozzle 140*c* may be located at an upper elevation of the furnace 110. The injected air, together with the lignin, wood extracts, and other organic compounds maintain combustion in the furnace 110. The partially dried and reacted black liquor accumulates in a mound at the bottom of the furnace known as a "char bed" 150. Inorganic compounds are reduced in the char bed 150 into a molten smelt. The smelt may accumulate and flow out of the furnace through smelt spouts 160 and into a collection tank. The reactions produced in the furnace consume heat. Airflow and black liquor input may be regulated and redistributed to promote and maintain combustion for efficient chemical recovery.

In conventional recovery boilers, the furnace is internally lined with a series of densely arranged high-pressure coolant-filled tubes. The coolant is commonly water and a collective series of tubes is referred to as a "water wall" 120. To regulate furnace temperature efficiently, the water wall 120 covers a large internal surface area of the furnace 110. In some chemical recovery boilers, three inch coolant tubes are separated by one inch filler bars to form a gas-tight barrier enclosing the furnace.

To operate safely and efficiently, the furnace generally operates under negative pressure. A constant inflow of air near the base of the furnace is needed to maintain combustion and to replace air and other gases that exit the recovery boiler near the top of the furnace. Air enters the otherwise gas-tight furnace through openings in the furnace water walls. Such openings include air ports and throats which are designed to inject pressurized air. Ambient air generally flows through other openings, such as those for smelt spouts, due to the negative pressure in the furnace. For most such openings, the coolant tubes of the water wall generally bend around the opening.

Air manifolds or windboxes (not shown) generally flank the openings of the throats and air ports on the outer wall of the furnace. Large fans ducted to the windboxes can cause air to flow into the furnace through the various throats and air ports in the furnace walls. The recovery boiler 100 may have a primary windbox, a secondary windbox, and a tertiary windbox spanning the sides of the furnace 110. The windboxes generally span the sides of the furnace 110 horizontally and may contain other instruments (not shown) such as air nozzles or probes to record furnace conditions. The primary windbox is generally closest to the ground (e.g., at a low elevation of the furnace) and the tertiary windbox is generally furthest from the ground (e.g., at an upper elevation of the furnace).

Airflow is a variable of furnace operation along with the rate of black liquor input. Large quantities of air are forced through the narrow openings of the throats and air ports to maintain combustion. The flow of air through a throat and diffuser, or swirler, (not shown) is desirable to maintain auxiliary combustion from active startup burners. However, conditions within the furnace contribute to the gradual obstruction of air flow as smelt slowly accumulates over the various openings. Over time, accumulations of frozen smelt on and around the coolant tubes can obstruct the openings, thereby reducing the ability to regulate combustion. Recovery boilers may need to be deactivated when smelt accumulations significantly interfere with operation. This extensive maintenance period results in loss of production.

Startup burners help regulate internal furnace temperature. Startup burners are auxiliary burners that may be used to initiate combustion within the furnace after a period of dormancy. Startup burners increase furnace temperature enough to commence black liquor firing. The startup burners are generally deactivated once furnace temperature increases to the point where black liquor itself sustains combustion.

When inactive, the startup burner may rest in the windbox within a burner housing adjacent to a throat opening. Radiant heat from the furnace can damage inactive startup burners. Moreover, splashes of black liquor through the throat openings can cause smelt fouling on the firing end of the startup burner that includes the fuel nozzles, swirler, igniter assembly, and flame detection equipment. Smelt fouling can render the startup burner ineffective, unsafe, and unreliable.

Swirlers and/or diffusers may be included on the firing end of a startup burner to cause a swirling action of combustion air just prior to entering the flame, thereby creating the necessary turbulence for thorough and efficient mixing with the fuel. The startup burner swirlers and/or diffusers are prone to fouling resulting in decreased recovery boiler efficiency. Further, the design and position of the swirler/diffuser make it difficult to extract the startup burner for cleaning of the swirler/diffuser while the boiler is online. There is a need to increase the intervals between recovery boiler maintenance and to reduce the amount of maintenance time while preserving or improving the operability of the recovery boiler after performing the maintenance.

SUMMARY

Apparatuses and systems for providing swirling of combustion air for a recovery boiler startup burner are provided.

According to various aspects there is provided startup burner assembly for a recovery boiler. In some aspects, the startup burner assembly may include: a housing having a burner end and a second end distal to the burner end; a main fuel conduit disposed within the housing; and high-pressure air conduits disposed within the burner end of the housing. The high-pressure air conduits include angled air injection nozzles configured to direct high-pressure air exiting the burner end of the startup burner assembly in a rotational direction.

According to various aspects there is provided a furnace for a recovery boiler. In some aspects, the furnace for a recovery boiler may include: a windbox configured for providing air to the furnace; a water wall configured for controlling a temperature of the furnace; and a startup burner assembly configured to generate heat for the furnace. The startup burner assembly may include: a housing having a burner end and a second end distal to the burner end; a main fuel conduit disposed within the housing; and high-pressure air conduits disposed within the burner end of the housing. The high-pressure air conduits may include angled air injection nozzles configured to direct high-pressure air exiting the burner end of the startup burner assembly in a rotational direction. The startup burner assembly may be configured to extend into the furnace through openings in the windbox and the water wall.

According to various aspects there is provided a recovery boiler. In some aspects, the recovery boiler may include: a furnace; and a startup burner assembly configured to generate heat for the furnace. The startup burner assembly may include: a housing having a burner end and a second end distal to the burner end; a main fuel conduit disposed within the housing; and high-pressure air conduits disposed within the burner end of the housing. The high-pressure air conduits may include angled air injection nozzles configured to direct high-pressure air exiting the burner end of the startup burner assembly in a rotational direction.

BRIEF DESCRIPTION OF THE DRAWINGS

Aspects and features of the various embodiments will be more apparent by describing examples with reference to the accompanying drawings, in which.

DETAILED DESCRIPTION

Figure 1:
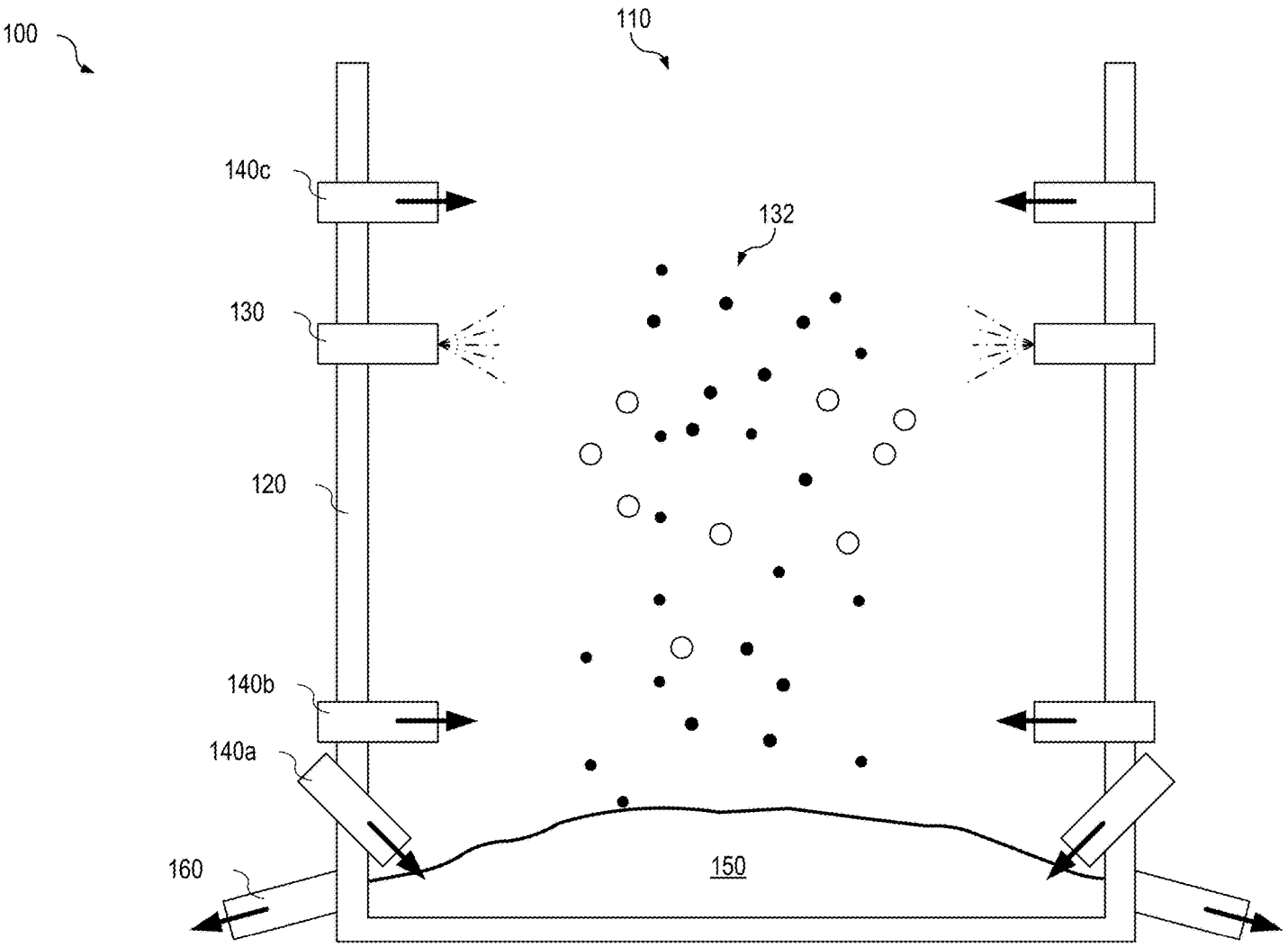
FIG. 1 is a simplified diagram of a conventional recovery boiler.

While certain embodiments are described, these embodiments are presented by way of example only, and are not intended to limit the scope of protection. The apparatuses, methods, and systems described herein may be embodied in a variety of other forms. Furthermore, various omissions, substitutions, and changes in the form of the example methods and systems described herein may be made without departing from the scope of protection.

Similar reference characters indicate corresponding parts throughout the several views unless otherwise stated. Although the drawings represent embodiments of various features and components according to the present disclosure, the drawings are not necessarily to scale and certain features may be exaggerated in order to better illustrate embodiments of the present disclosure, and such exemplifications are not to be construed as limiting the scope of the present disclosure.

Except as otherwise expressly stated herein, the following rules of interpretation apply to this specification: (a) all words used herein shall be construed to be of such gender or number (singular or plural) as to circumstances require; (b) the singular terms "a," "an," and "the," as used in the specification and the appended claims include plural references unless the context clearly dictates otherwise; (c) the antecedent term "about" applied to a recited range or value denotes an approximation within the deviation in the range or values known or expected in the art from the measurements; (d) the words "herein," "hereby," "hereto," "hereinbefore," and "hereinafter," and words of similar import, refer to this specification in its entirety and not to any particular paragraph, claim, or other subdivision, unless otherwise specified; (e) descriptive headings are for convenience only and shall not control or affect the meaning or construction of any part of the specification; and (f) "or" and "any" are not exclusive and "include" and "including" are not limiting. Further, the terms, "comprising," "having," "including," and "containing" are to be construed as open-ended terms (i.e., meaning "including but not limited to").

Recitation of ranges of values herein are merely intended to serve as a shorthand method of referring individually to each separate value falling within the range of within any sub ranges there between, unless otherwise clearly indicated herein. Each separate value within a recited range is incorporated into the specification or claims as if each separate value were individually recited herein. Where a specific range of values is provided, it is understood that each intervening value, to the tenth or less of the unit of the lower limit between the upper and lower limit of that range and any other stated or intervening value in that stated range or sub range hereof, is included herein unless the context clearly dictates otherwise. All subranges are also included. The upper and lower limits of these smaller ranges are also included therein, subject to any specifically and expressly excluded limit in the stated range.

Aspects of the present disclosure can provide mechanisms to cause swirling of combustion air for a recovery boiler startup burner without the use of a diffuser or swirler. Startup burners help regulate internal furnace temperature. Startup burners are auxiliary burners that commonly fire natural gas, propane, and/or fuel oil, and are used to initiate combustion within the furnace after a period of dormancy. The startup burners may increase furnace temperature to a minimum temperature that enables combustion from black liquor firing. Black liquor firing may be increased until the black liquor itself can sustain combustion. Once sustained combustion is achieved with the black liquor, the startup burners may be deactivated. Startup burns may also be used to provide supplementary heat to the furnace when black liquor flow is interrupted or is insufficient to meet boiler demand.

Fuel and air mixing may be accelerated and controlled to some degree by the placement of a diffuser or swirler in or near the burner throat. The diffuser obstructs the flow of air and fuel droplets to introduce turbulence that facilitates air-fuel mixing. The diffuser can be configured to spin to further facilitate the mixing process. Windboxes may feed a near constant flow of air into the recovery boiler to maintain combustion. To facilitate efficient pyrolysis, a cyclone of airflow into the recovery boiler may be created. However, the pyrolysis reaction in the recovery boiler produces inorganic compounds commonly referred to as "smelt" that can freeze on the diffuser and obstruct the flow of air and fuel, thereby preventing efficient mixing and resulting in fuel and energy waste. Some startup burner designs do not allow for the extraction of inactive startup burners for cleaning when the recovery boiler is active.

Startup burners on recovery boilers may include a housing commonly referred to as a "lance" or a "gun" positioned at openings in the furnace wall. The startup burner lance may or may not be retractable. When the startup burner lance is retractable, the retraction may or may not be automated. Startup burners have a burner end that extends to or through the throat of the furnace. The throat may be shaped, for example, as a venturi, or the throat may simply be an opening in the furnace wall. The furnace wall may be a water tube panel, or "water wall." A recovery boiler water wall may have a width of about 30 feet to about 40 feet and may be used to control furnace temperature.

Figure 2A:
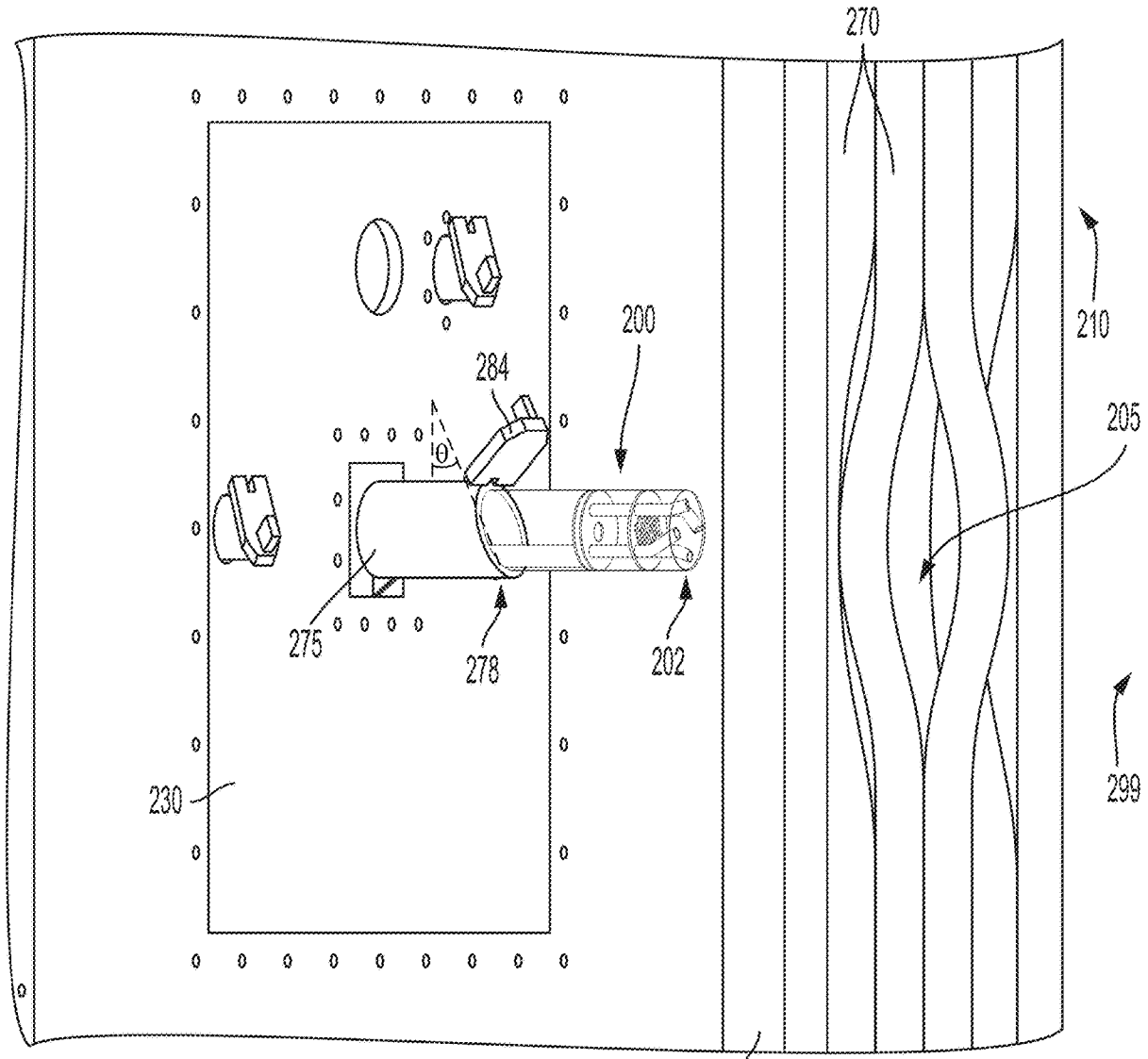
FIG. 2A is a diagram illustrating an example of a startup burner assembly extended through a cover plate of a furnace according to some aspects of the present disclosure.

FIG. 2A is a diagram illustrating an example of a startup burner assembly 200 extended through a cover plate 230 of a furnace according to some aspects of the present disclosure. The startup burner assembly 200 may have a burner end 202 extending through a windbox interior 290 toward a throat 205 in a water wall 210 of the furnace of the recovery boiler. In some implementations, the startup burner assembly 200 may be extractable. The startup burner assembly 200 may be completely removed from the furnace while the furnace is in operation as well as when the furnace is shut down. The extension and extraction of the startup burner assembly 200 may be performed automatically or manually. In some implementations, the startup burner assembly 200 may not be retractable.

The water wall 210 may include a plurality of tubes 270 configured to be filled with water or another fluid for regulating the temperature of the furnace interior 299. The tubes 270 may be formed to create an open area that defines the throat 205. In other embodiments, the throat 205 may be further defined by a reinforcing element (not shown) disposed within the opening formed by the tubes 270. The reinforcing element may conform to the hole defined by the tubes 270 and may be made from carbon steel or other material configured to withstand furnace heat.

The startup burner assembly 200 may include an inlet (not shown) disposed at the supply end of the startup burner assembly 200 on an opposite side of the cover plate 230. Natural gas, air, or other fuel may be supplied to the startup burner assembly 200 from the inlet at the supply end of the startup burner assembly 200. The fuel may flow along the length of the startup burner assembly 200 and into the furnace. Air may enter the furnace through the throat 205. The fuel input and amount of air entering the furnace may be monitored by instrumentation (not shown) in the windbox interior 290 to increase furnace temperature and melt or burn away smelt accumulations.

The startup burner assembly 200 may be disposed in a burner guide sleeve 275. The burner guide sleeve 275 may extend through the cover plate 230 into the windbox interior 290 and may at least partially support the startup burner assembly 200. The burner guide sleeve 275 may include a plug (not shown) at an outer end of the burner guide sleeve 275 and a flapper valve 284 at an inner end 278 of the burner guide sleeve 275. The plug may be configured to prevent hot air flowing out from the windbox interior 290 when the startup burner assembly 200 is in use. The flapper valve 284 may be configured to rest on the startup burner assembly 200 when the startup burner assembly 200 is inserted into the windbox interior 290 towards the throat 205 and the furnace interior 299. When the startup burner assembly 200 is extracted past the flapper valve 284, the flapper valve 284 may be configured to close and rest on a front lip of the burner guide sleeve 275 at an angle θ. The angle θ of closure of the flapper valve 284 may increase the ability of the flapper valve 284 to remain closed during furnace operation when the startup burner assembly 200 is extracted from the furnace.

Figure 2B:
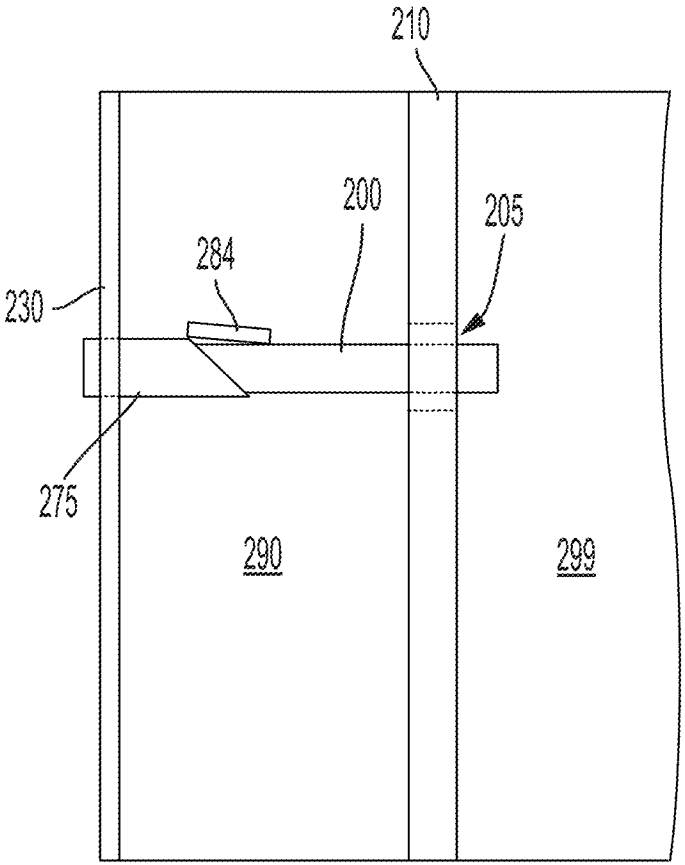
FIG. 2B is a simplified diagram illustrating the startup burner assembly extended through the windbox interior and into the furnace interior through the throat in the water wall.

FIG. 2B is a simplified diagram illustrating the startup burner assembly 200 extended through the windbox interior 290 and into the furnace interior 299 through the throat 205 in the water wall 210.

An igniter assembly (not shown) may be used in conjunction with the startup burner assembly 200. The igniter assembly may include an ionizing flame rod and spark rod as well as intake ports through which air and natural gas may flow. The igniter assembly may also include safety equipment used to ensure continuous ignition at the fuel nozzle tip of the startup burner assembly 200. In some implementations, the igniter assembly may be co-extensive with the startup burner assembly 200.

Figure 3:
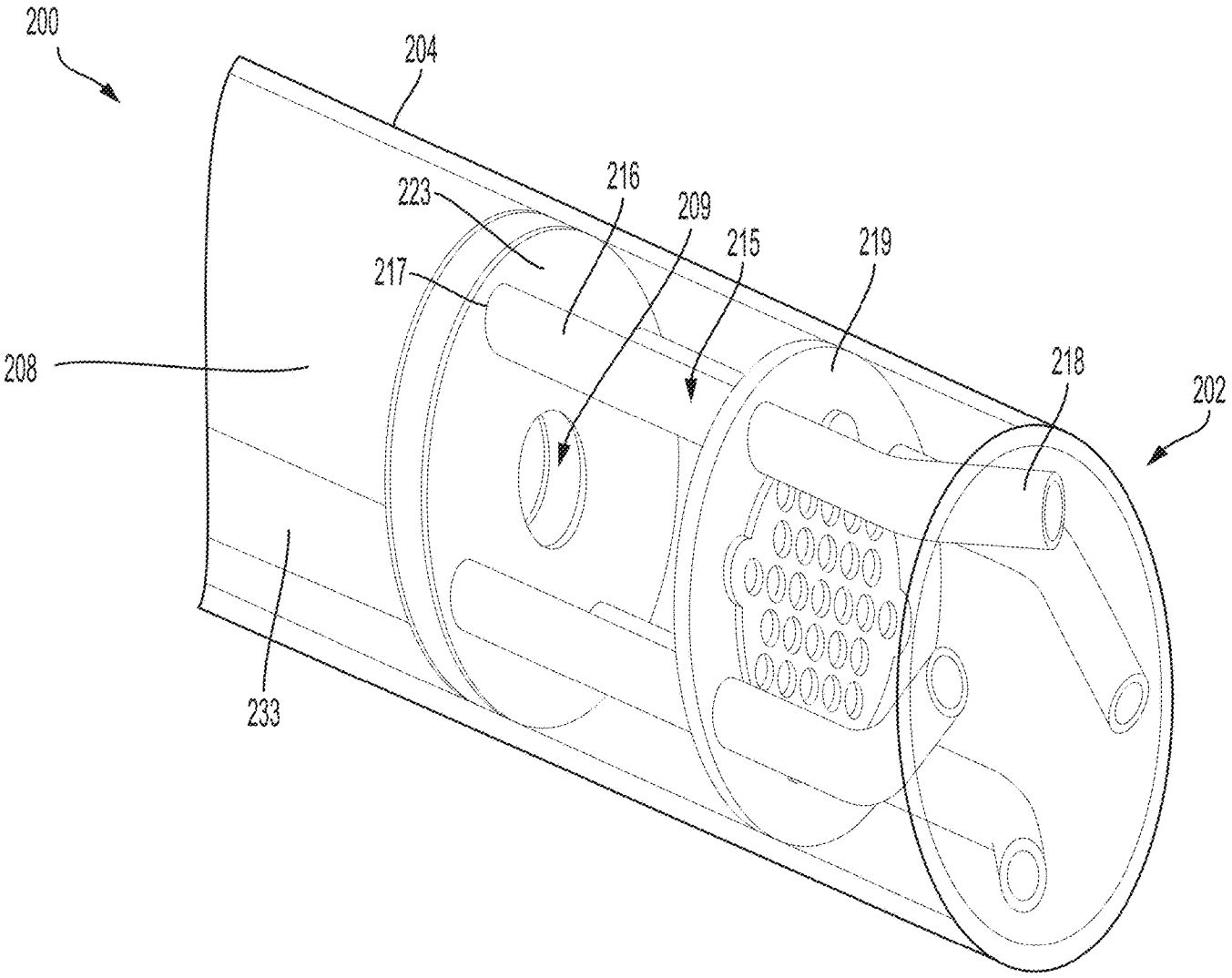
FIG. 3 is a diagram illustrating an example of a startup burner assembly according to some aspects of the present disclosure.

FIG. 3 is a diagram illustrating an example of a startup burner assembly 200 according to some aspects of the present disclosure. The startup burner assembly 200 may include a housing 204 having a burner end 202 and a supply end (not shown) distal to the burner end 202. The housing 204 may include a high-pressure air duct 233 and a main fuel conduit 208 disposed within the housing 204. The housing 204 may form a portion of the main fuel conduit 208. The high-pressure air duct 233 may be in fluid communication with a high-pressure air source (not shown) external to the recovery boiler. High-pressure air conduits 215 may be disposed the burner end 202 of the housing 204. Each of the high-pressure air conduits 215 may include a body 216, an air injection nozzle 218 disposed at the burner end 202 of the housing 204, and a second end 217 in fluid communication with a manifold 223.

A dropletizer 219 may be disposed downstream of the manifold 223. Fuel (e.g., natural gas or other fuel) from the main fuel conduit 208 can flow through an opening 209 in the manifold 223 before encountering the dropletizer 219. The fuel may be dispersed into droplets by flowing through a plurality of holes in the dropletizer 219 to thereby increase the surface area of the fuel and to promote efficient mixing with air downstream of the dropletizer 219.

The high-pressure air duct 233 may fluidly communicate with the manifold 223. The manifold 223 in turn may fluidly communicate with the multiple high-pressure air conduits 215 via the second end 217 of the high-pressure air conduits 215 to distribute the high-pressure air to the high pressure air conduits 215. High-pressure air can flow from the high-pressure air duct 233 through the manifold 223 and through the high pressure air conduits 215 to the burner end 202 of the housing 204.

Figure 4:
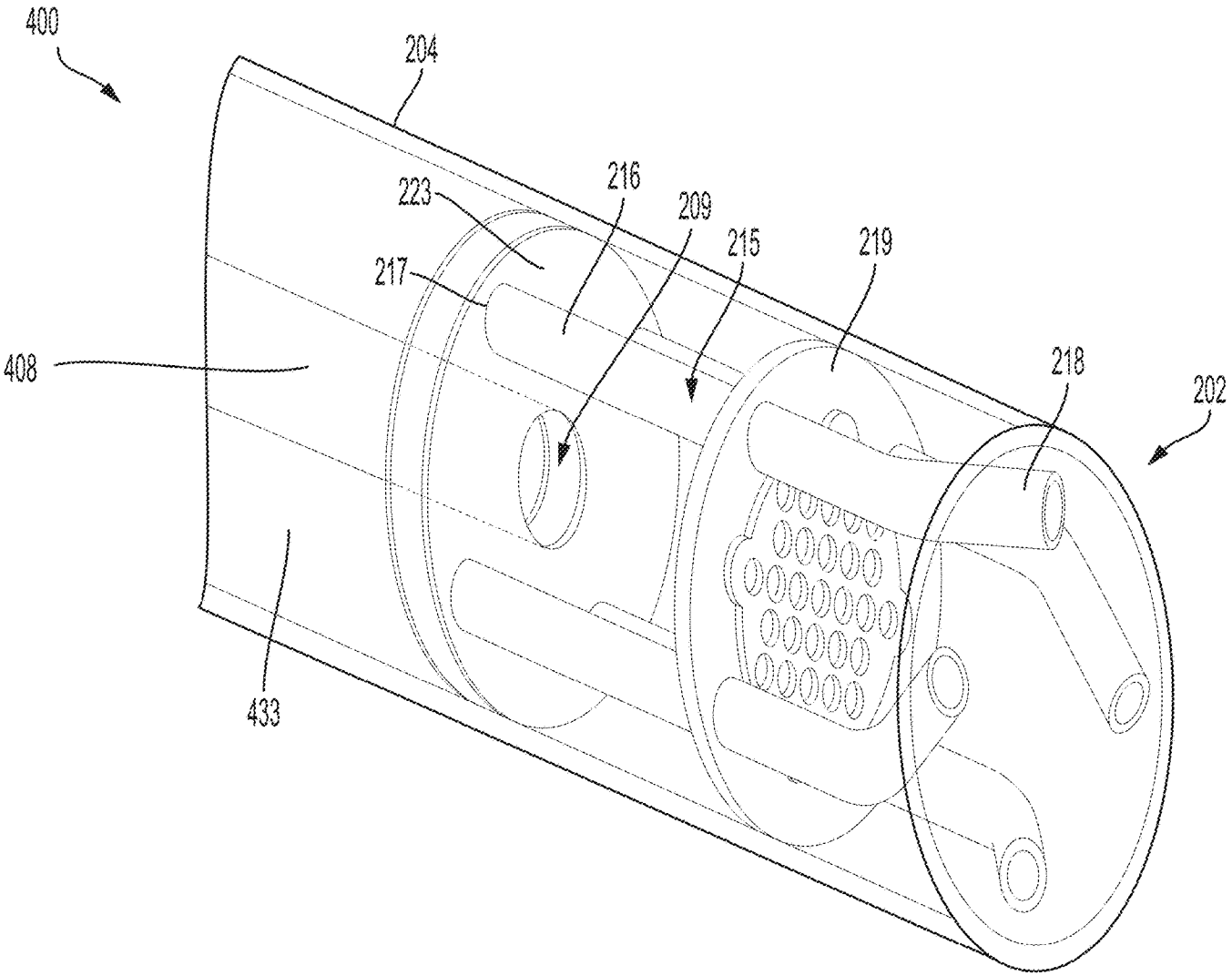
FIG. 4 is a diagram illustrating another example of a startup burner assembly according to some aspects of the present disclosure.

In some implementations, the housing may act as the high-pressure air duct and may fluidly communicate with the manifold to deliver the compressed air to the high pressure air conduits, and the main fuel conduit may be a separate pipe disposed within the housing. FIG. 4 is a diagram illustrating another example of a startup burner assembly 400 according to some aspects of the present disclosure. Referring to FIG. 4, the main fuel conduit 408 may be configured to deliver fuel (e.g., natural gas or other fuel) to the opening 209 in the manifold 223. The housing 204 may form the high-pressure air duct 433 configured to deliver high pressure air to the manifold 223.

Figure 5:
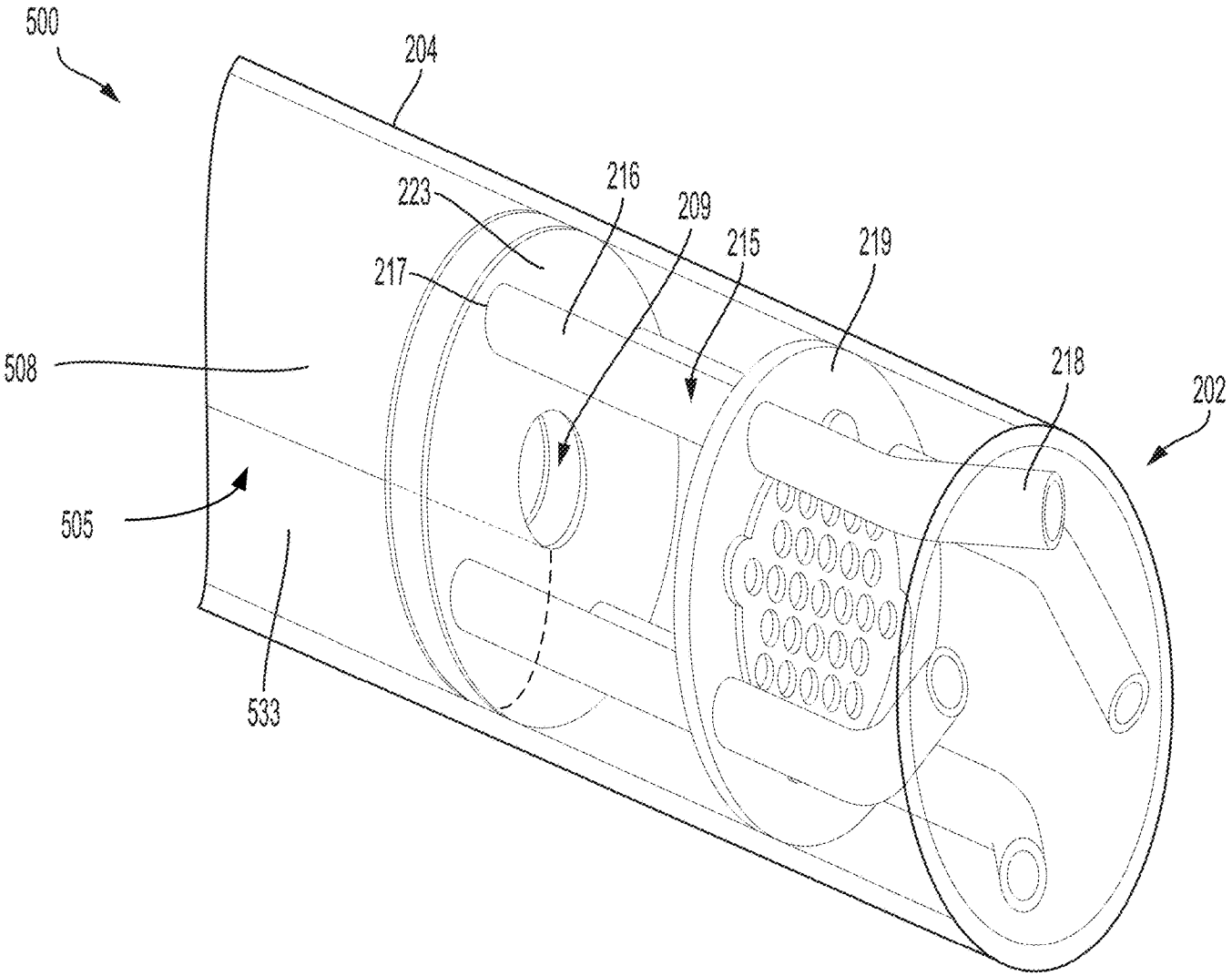
FIG. 5 is a diagram illustrating another example of a startup burner assembly according to some aspects of the present disclosure.

In some implementations, the housing may include a divider with a portion of the housing on one side of the divider acting as the main fuel conduit and another portion of the housing on an opposite side of the divider acting as the high-pressure air duct. FIG. 5 is a diagram illustrating another example of a startup burner assembly 500 according to some aspects of the present disclosure. Referring to FIG. 5, a divider 505 may separate the internal portion of the housing 204 into a main fuel conduit 508 and a high-pressure air duct 533. The main fuel conduit 508 may deliver fuel to the opening 209 in the manifold 223. The high-pressure air duct 533 may be configured to deliver high pressure air to the manifold 223. Other configurations of the housing with or without internal piping or dividers are possible without departing from the scope of the present disclosure.

As the dropletized fuel continues to move to the burner end 202 of the startup burner assembly 200, the dropletized fuel may encounter the high pressure air provided from the air injection nozzle 218 of each high-pressure air conduit 215 resulting in generation of a flame when the droplets are ignited. Each air injection nozzle 218 of a high-pressure air conduit 215 may be angled relative to the body 216 of the high-pressure air conduit 215. In some implementations, the high-pressure air conduits 215 and/or air injection nozzles 218 may be unevenly spaced around a circumference of the burner end 202 of the housing 204. In some implementations, the high-pressure air conduits 215 and/or air injection nozzles 218 may be evenly spaced around a circumference of the burner end 202 of the housing 204. At least two air injection nozzles 218 may be provided.

The angle of the air injection nozzles 218 may direct the high-pressure air exiting the air injection nozzles in a rotational direction. In some implementations, the angle of the air injection nozzle 218 with respect to the high-pressure air conduit 215 may be the same for each air injection nozzle 218. In some implementations, the angle of the air injection nozzle 218 with respect to the high-pressure air conduit 215 may vary for the air injection nozzles 218. For example, two of the air injection nozzles 218 may be disposed at a first angle with respect to the high-pressure air conduits 215 and two other the air injection nozzles 218 may be disposed at a second angle with respect to the high-pressure air conduits 215. Other configurations of angles for the air injection nozzles are possible without departing from the scope of the present disclosure.

The rotation of the high-pressure air as well as high fuel injection pressure may cause the flame to swirl into a desirable cyclone shape to promote efficient air and fuel mixing and combustion within the furnace. The burner end 202 of the startup burner assembly 200 may be open to permit the flame to be provided directly into the furnace interior.

Thus, startup burner assemblies having high-pressure air injection nozzles according to aspects of the present disclosure can obviate the need for diffusers and/or swirlers and thereby avoid the problems resulting from diffuser/swirler fouling and inaccessibility during boiler operation. Without being bound by theory, the use of high pressure (e.g., compressed air) can increase the stoichiometry and/or increase the heat input through existing openings in the furnace wall.

The examples and embodiments described herein are for illustrative purposes only. Various modifications or changes in light thereof will be apparent to persons skilled in the art. These are to be included within the spirit and purview of this application, and the scope of the appended claims, which follow.

What is claimed is:

1. A startup burner assembly for a recovery boiler, the startup burner assembly comprising:
   - a housing having a burner end and a second end distal to the burner end;
   - a main fluid fuel conduit disposed within the housing; and
   - a plurality of high-pressure air conduits disposed within the burner end of the housing, the high-pressure air conduits comprising angled air injection nozzles, wherein the high-pressure air conduits extend within the housing and are configured to convey high pressure air to the angled air injection nozzles, and the angled air injection nozzles are configured to direct high-pressure air exiting the burner end of the startup burner assembly in a rotational direction.

2. The startup burner assembly of claim 1, further comprising a dropletizer including a plurality of holes, the dropletizer configured to increase a surface area of fuel flowing from the main fluid fuel conduit by dispersing the fuel into droplets as the fuel flows through the plurality of holes.

3. The startup burner assembly of claim 1, wherein the angled air injection nozzles are configured to cause swirled high-pressure air to mix with fuel droplets to generate cyclone-shaped flames when the fuel droplets are ignited.

4. The startup burner assembly of claim 1, wherein the angled air injection nozzles of the high-pressure air conduits are angled relative to bodies of the high-pressure air conduits.

5. The startup burner assembly of claim 1, further comprising:

a high-pressure air duct configured to conduct high-pressure air from a high-pressure air source; and a manifold in fluid communication with the high-pressure air duct, the manifold being configured to distribute the high-pressure air to the high-pressure air conduits.

6. The startup burner assembly of claim 5, wherein the manifold comprises an opening in fluid communication with the main fluid fuel conduit.

7. The startup burner assembly of claim 1, wherein the housing forms at least a portion of the main fluid fuel conduit.

8. A furnace for a recovery boiler, the furnace comprising:

a windbox configured for providing air to the furnace;

a water wall configured for controlling a temperature of the furnace; and a startup burner assembly configured to generate heat for the furnace, the startup burner assembly comprising:

a housing having a burner end and a second end distal to the burner end;

a main fluid fuel conduit disposed within the housing; and a plurality of high-pressure air conduits disposed within the burner end of the housing, the high-pressure air conduits comprising angled air injection nozzles, wherein the high-pressure air conduits extend within the housing and are configured to convey high pressure air to the angled air injection nozzles, and the angled air injection nozzles are configured to direct high-pressure air exiting the burner end of the startup burner assembly in a rotational direction, wherein the startup burner assembly is configured to extend into the furnace through openings in the windbox and the water wall.

9. The furnace of claim 8, wherein the startup burner assembly further comprises:

a dropletizer including a plurality of holes, the dropletizer configured to increase a surface area of fuel flowing from the main fluid fuel conduit by dispersing the fuel into droplets as the fuel flows through the plurality of holes.

10. The furnace of claim 8, wherein the angled air injection nozzles are configured to cause swirled high-pressure air to mix with fuel droplets to generate cyclone-shaped flames when the fuel droplets are ignited.

11. The furnace of claim 8, wherein the angled air injection nozzles of the high-pressure air conduits are angled relative to bodies of the high-pressure air conduits.

12. The furnace of claim 8, wherein the startup burner assembly further comprises:

a high-pressure air duct configured to conduct high-pressure air from a high-pressure air source; and a manifold in fluid communication with the high-pressure air duct, the manifold being configured to distribute the high-pressure air to the high-pressure air conduits.

13. The furnace of claim 12, wherein the manifold comprises an opening in fluid communication with the main fluid fuel conduit.

14. The furnace of claim 8, further comprising a guide sleeve, wherein the housing is disposed within the guide sleeve.

15. A recovery boiler, comprising:

a furnace; and a startup burner assembly configured to generate heat for the furnace, the startup burner assembly comprising:

a housing having a burner end and a second end distal to the burner end;

a main fluid fuel conduit disposed within the housing; and a plurality of high-pressure air conduits disposed within the burner end of the housing, the high-pressure air conduits comprising angled air injection nozzles, wherein the high-pressure air conduits extend within the housing and are configured to convey high pressure air to the angled air injection nozzles, and the angled air injection nozzles are configured to direct high-pressure air exiting the burner end of the startup burner assembly in a rotational direction.

16. The recovery boiler of claim 15, wherein the startup burner assembly further comprises:

a dropletizer including a plurality of holes, the dropletizer configured to increase a surface area of fuel flowing from the main fluid fuel conduit by dispersing the fuel into droplets as the fuel flows through the plurality of holes.

17. The recovery boiler of claim 15, wherein the angled air injection nozzles are configured to cause swirled high-pressure air to mix with fuel droplets to generate cyclone-shaped flames when the fuel droplets are ignited.

18. The recovery boiler of claim 15, wherein the angled air injection nozzles of the high-pressure air conduits are angled relative to bodies of the high-pressure air conduits.

19. The recovery boiler of claim 15, wherein the startup burner assembly further comprises:

a high-pressure air duct configured to conduct high-pressure air from a high-pressure air source; and a manifold in fluid communication with the high-pressure air duct, the manifold being configured to distribute the high-pressure air to the high-pressure air conduits.

20. The recovery boiler of claim 19, wherein the manifold comprises an opening in fluid communication with the main fluid fuel conduit.

21. A startup burner assembly for a recovery boiler, the startup burner assembly comprising:

a housing having a burner end and a second end distal to the burner end;

a main fluid fuel conduit disposed within the housing; and at least one high-pressure air conduit disposed within the burner end of the housing, the at least one high-pressure air conduit comprising at least one angled air injection nozzle, wherein the at least one high-pressure air conduit extends through the housing and is configured to convey high pressure air to the at least one angled air injection nozzle, and the at least one angled air injection nozzle is configured to direct high-pressure air exiting the burner end of the startup burner assembly in a rotational direction.

22. The startup burner assembly of claim 21, wherein the angled air injection nozzle is configured to cause swirled high-pressure air to mix with fuel droplets to generate cyclone-shaped flames when the fuel droplets are ignited.

* * * * *